US006631856B2

(12) United States Patent
Herr

(10) Patent No.: US 6,631,856 B2
(45) Date of Patent: Oct. 14, 2003

(54) STEAM HUMIDIFIER WITH PRESSURE VARIABLE APERTURE

(76) Inventor: D. Scott Herr, 1834 Freedom Rd., Lancaster, PA (US) 17601

( * ) Notice: Subject to any disclaimer, the term of this patent is extended or adjusted under 35 U.S.C. 154(b) by 28 days.

(21) Appl. No.: 09/879,975

(22) Filed: Jun. 14, 2001

(65) Prior Publication Data

US 2001/0045674 A1 Nov. 29, 2001

Related U.S. Application Data

(63) Continuation-in-part of application No. 09/358,696, filed on Jul. 21, 1999.

(51) Int. Cl.[7] ..... B05B 1/30; B05B 1/34; B05B 15/00; B05B 1/00

(52) U.S. Cl. ..... 239/533.13; 239/547; 239/602; 239/436

(58) Field of Search ..... 239/533.13, 547, 239/602, 436, 568, 418, 434, 398, 412, 546, 437, 77, 451, 107, DIG. 12; 261/43, 96, 83, 92, DIG. 46; 138/124, 157

(56) References Cited

U.S. PATENT DOCUMENTS

| | | | | | |
|---|---|---|---|---|---|
| 3,096,817 | A | * | 7/1963 | McKenna | 165/60 |
| 3,186,644 | A | * | 6/1965 | Ross et al. | 239/533.13 |
| 3,333,422 | A | * | 8/1967 | Neyland | 405/48 |
| 3,899,135 | A | * | 8/1975 | O'Brian | 239/533.13 |
| 4,397,793 | A | * | 8/1983 | Stillman et al. | 261/30 |
| 5,516,466 | A | * | 5/1996 | Schlesch et al. | 261/117 |
| 5,649,860 | A | * | 7/1997 | Giuffrida | 454/306 |
| 6,488,219 | B1 | * | 12/2002 | Herr | 239/533.13 |

* cited by examiner

*Primary Examiner*—Davis Hwu
(74) *Attorney, Agent, or Firm*—Shlesinger, Arkwright & Garvey LLP

(57) ABSTRACT

A humidifier for providing moisture to an airstream comprises a pipe having a first end for connecting to a source of steam and a closed second end; first and second slots disposed opposite each other and longitudinally along a major portion of the length of the pipe; and a plurality of members sandwiched within the first and second slots, the members being disposed toward the interior of the pipe to guide condensate into the interior of the pipe.

19 Claims, 8 Drawing Sheets

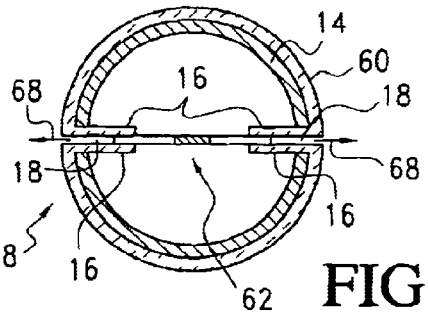
FIG.13
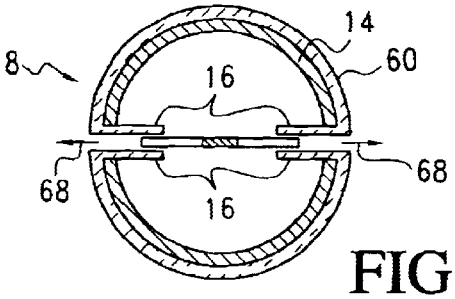
FIG.14
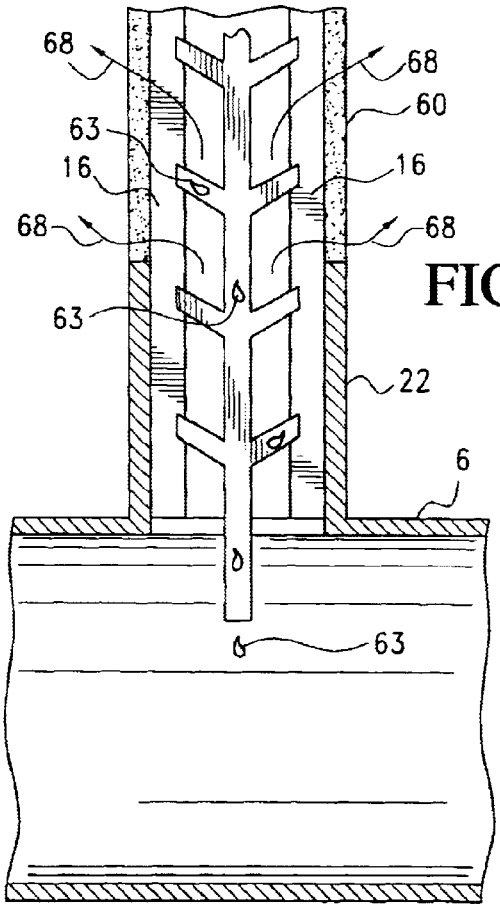
FIG.17
FIG.15
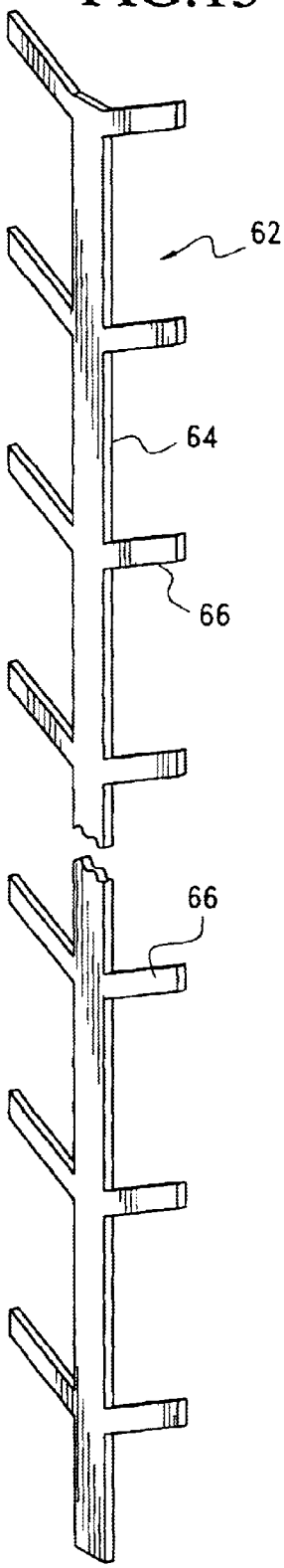

STEAM HUMIDIFIER WITH PRESSURE VARIABLE APERTURE

RELATED APPLICATION

This a continuation-in-part application claiming the priority benefit of application Ser. No. 09/358,696, filed Jul. 21, 1999, which is hereby incorporated by reference.

FIELD OF THE INVENTION

The present invention relates generally to a steam humidifier used in HVAC systems in buildings.

BACKGROUND OF THE INVENTION

Since 1985, most steam humidifiers used steam injection manifolds that contain nozzles in the duct distributor pipes. The nozzles can be in the form of plain holes placed along the length of the pipe. This arrangement has been found to be unsatisfactory, since it allows the condensate to flow out of the holes into the airstream along with the steam. By using nozzles instead of plain holes that feed off the center of the pipe where the steam is hottest and driest, condensate is prevented from getting out with the steam.

However, it is labor intensive to install the nozzles into the steam distributor pipes, since holes must be drilled before the nozzles can be inserted into them and if a mistake is made on capacity, it is very difficult, if not impossible, to add nozzles to increase capacity. Exceeding the capacity of the nozzles results in a very heavy steam flow, which takes longer to evaporate in the airstream. In some cases, the nozzles used have been made of plastic and can come loose and leak or blow out of the distributor pipes.

To shorten the distance it takes for the steam to evaporate in the airduct, the number of distributor pipes have been increased to spread out the steam output over the entire cross-sectional area of the airduct. However, because there is now more surface of the distributor pipes exposed to the cold airstream, the result is usually more condensate production (which can be as much as 50% loss of the steam to condensate), loss of steam output, and heat-gain to the air in the airduct, which could be as much as 15° F. If the building is under cooling load, this heat-gain to the airstream will be detrimental to maintaining the building temperature.

In view of the above, there is, therefore, a need for a steam humidifier that avoids the shortcomings of the prior art.

OBJECTS AND SUMMARY OF THE INVENTION

It is an object of the present invention to provide a steam humidifier where the steam distributor pipes are provided with pressure variable apertures, instead of standard nozzles, that adjust their output to meet the demand.

It is another object of the present invention to provide a steam humidifier where the steam distributor pipes are installed to the manifold with slip fittings without tools, allowing the pipes to be easily disassembled and cut to fit the height of the airduct.

It is still another object of the present invention to provide a steam humidifier where the distributor pipes can be cut in the field to fit the height of the existing airduct without any detrimental effect to its steam distribution capacity.

It is another object of the present invention to provide a steam humidifier that can easily be retrofitted to switch to a different means of steam production, including direct steam, steam heat exchanger, electric coil, or gas-fired heat exchanger.

It is still another object of the present invention to provide a steam humidifier where the steam distributor pipes are insulated and where the nozzles are fed from the central part of the pipes where steam is hottest and driest, thereby minimizing production of condensate.

It is another object of the present invention to provide a steam humidifier where the contact ratio of steam to air is substantially 100%.

It is still another object of the present invention to provide a steam humidifier that minimizes spitting from condensate and facilitates flow of condensate toward the interior and bottom of the distributor pipes where the steam is hottest and driest to flash much of the condensate back to usable steam.

It is another object of the present invention to provide a steam humidifier having a distributor pipe with an initial slot opening width that opens wider in response to the demand for humidity.

It is still another object of the present invention to provide a humidifier that includes distributor pipes with insulated outside surfaces to minimize heat transfer to the airstream, particularly during the airconditioning season, and maintain the inside surfaces smooth to facilitate flow of condensate back to the manifold for re-evaporation to steam.

In summary, the present invention provides a humidifier for providing moisture to an airstream within an airduct, comprising a base manifold configured for being secured to a side of the airduct, the base manifold including a steam inlet valve and a condensate drain valve; and a distributor pipe secured to the base manifold and configured to extend into the airduct, the distributor pipe being in communication with the base manifold.

The present invention also provides a humidifier for providing moisture to an airstream within an airduct, comprising a base manifold configured for being secured to a side of the airduct; a heat-exchanger disposed within the base manifold configured to boil water disposed within the base manifold to steam; and a distributor pipe secured to the base manifold and configured to extend into the airduct, the distributor pipe being in communication with the base manifold.

The present invention further provides a nozzle for dispensing moisture into an airstream, comprising a pipe having a first end for connecting to a source of steam and a closed second end; first and second slots disposed opposite each other and longitudinally along a major portion of the length of the pipe; and the pipe being subject to flexing such that the slots open up in response to the steam being introduced thereinto, thereby to release steam in the airstream.

The present invention also provides a method for humidifying an airstream in a duct, comprising providing a nozzle configured to provide a sheet pattern of spray; disposing the nozzle in the airstream; connecting the nozzle to a source of steam; directing the steam sheet pattern transversely to the direction of the airstream such that maximum surface area of the sheet pattern is presented to the airstream.

Further, the present invention provides a humidifier for providing moisture to an airstream, comprising a pipe having a first end for connecting to a source of steam and a closed second end; first and second slots disposed opposite each other and longitudinally along a major portion of the length of the pipe; and a plurality of members sandwiched within the first and second slots, the members being disposed toward the interior of the pipe to guide condensate into the interior of the pipe.

The present invention also provides a humidifier for providing moisture to an airstream within an airduct, comprising a pipe having a first end for connecting to a source of steam and a closed second end; first and second slots disposed opposite each other and longitudinally along a major portion of the length of the pipe; and an insert sandwiched within the first and second slots to provide the slots an initial opening width. The pipe is subject to flexing such that the slots open up to greater than the initial opening width in response to the steam being released through the first and second slots.

These and other objects of the present invention will become apparent from the following detailed description.

BRIEF DESCRIPTIONS OF THE DRAWINGS

FIG. 13 is a cross-sectional view taken along line 13—13 of FIG. 16.

FIG. 14 is a cross-sectional view similar to FIG. 13, but under increased load.

FIG. 15 is a perspective view of a structure used within the distributor pipes of the present invention.

FIG. 17 is an enlarged cross-sectional view of a portion of FIG. 16.

DETAILED DESCRIPTION OF THE INVENTION

Figure 1:
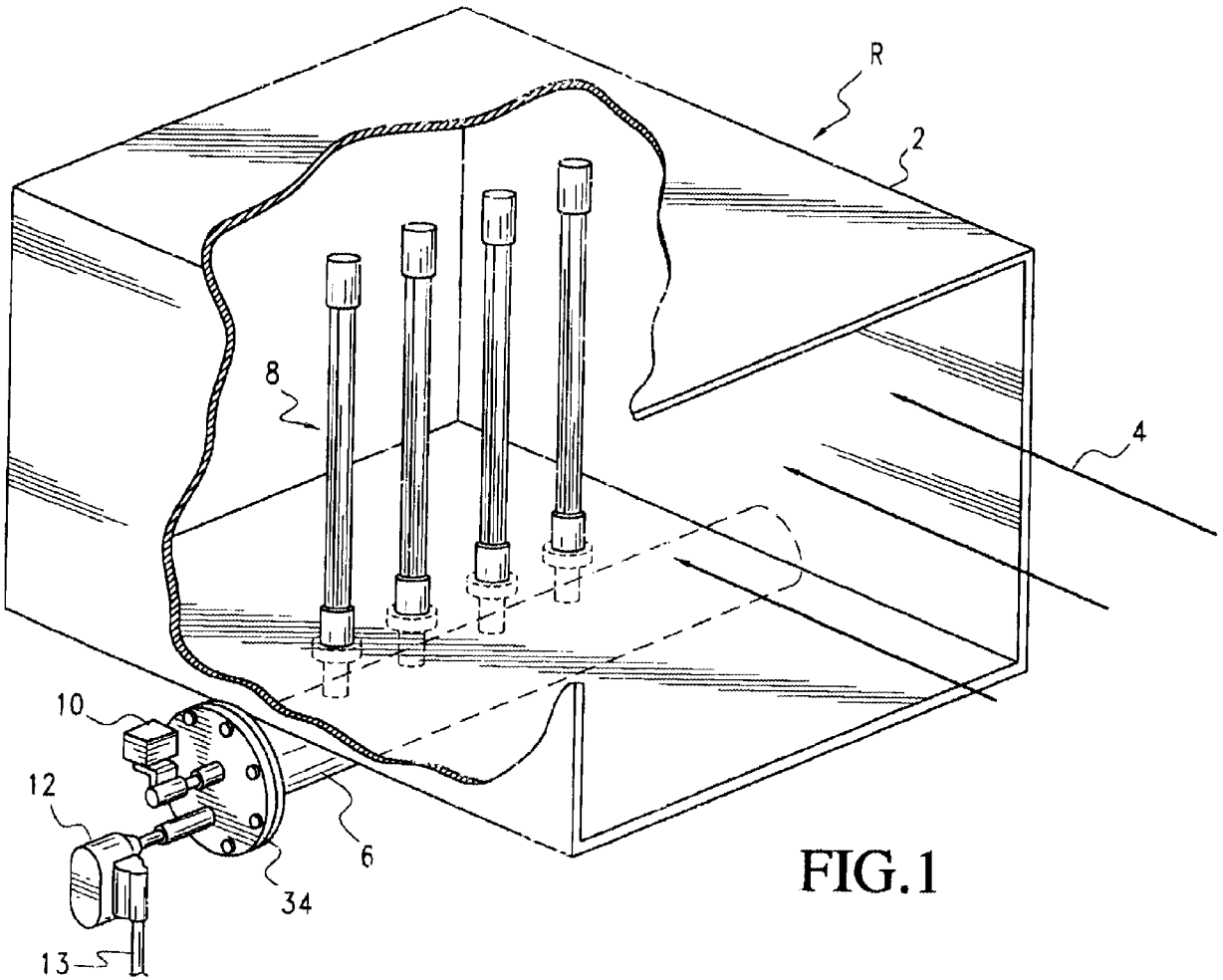
FIG. 1 is a schematic perspective view of a steam humidifier installed in an airduct with portions shown in cross-section and broken out.

A steam humidifier R made in accordance with the present invention is disclosed in FIG. 1. The humidifier R is operably associated with an airduct 2 in which an airstream 4 is maintained for the HVAC requirements of the building. Moisture is added to the airstream by means of the humidifier R to maintain the building air at some humidity levels.

Figure 2:
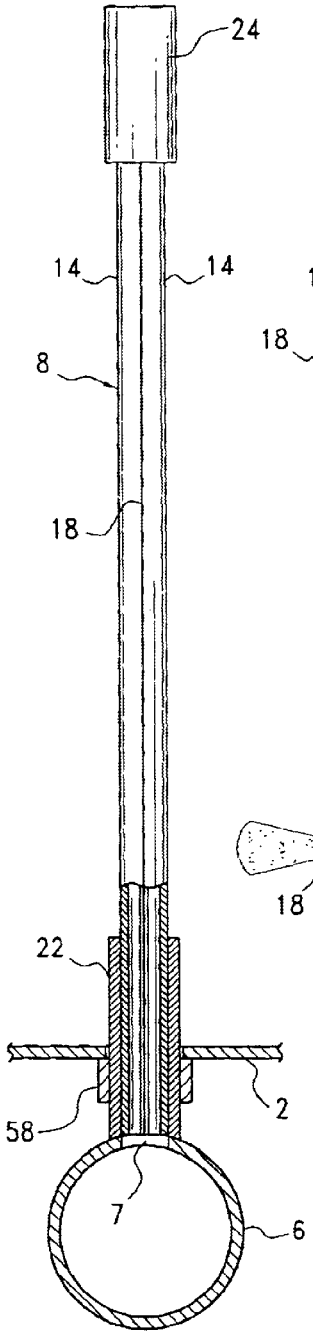
FIG. 2 is a side elevational view, with a portions in cross-section of the steam humidifier of the present invention, under low or no-load conditions.

The steam humidifier R comprises a base manifold 6, preferably disposed outside the airduct 2. A plurality of steam distributor pipes 8 are disposed within the airduct 2 and are operably connected to the base manifold 6. Each distributor pipe communicates with the base manifold through a respective opening 7, as best shown in FIG. 2. Each steam distributor pipe 8 functions as a nozzle, dispensing steam into the airstream 4.

Steam is supplied to the base manifold 6 through a valve 10 which may be controlled by a humidity sensor (not shown) or other standard controller. Condensate collects in the base manifold 6 and is drained out through a standard steam trap 12, which allows condensate to drain out to drain tube 13 but not the steam. The base manifold 6 separates the incoming steam from the condensate flowing down from the distributor pipe 8.

Figure 3:
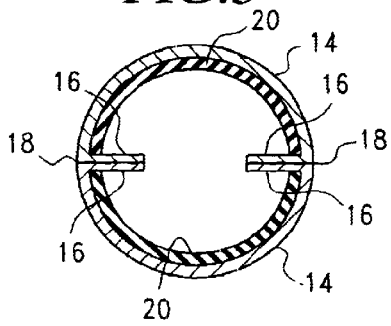
FIG. 3 is a cross-sectional view taken along line 3—3 of FIG. 6.

Each distributor pipe 8 is made from two half-pipe sections 14, as best shown in FIGS. 2 and 3. Each section 14 has inwardly directed flange portions 16 that define a slot 18 with the opposing flange portion 16 in the other half-pipe section 14. The flange portions 16 advantageously extend the slots 18 into the central portion of the distributor pipe 8 where the steam is driest to prevent condensate release into the airduct 2, which can cause wetting on the bottom of the airduct.

An insulating jacket 20 is disposed on the inside arcuate surface of each half-pipe section 14 to advantageously reduce condensate production, generally indicated at 21, thereby improving efficiency. The insulating jacket 20 also advantageously reduces the heat gain to the airduct, minimizing interference with the airconditioning system. Further, since the insulating jacket 20 is internal, no rubber or plastic parts are exposed to the airstream.

The insulating jacket 20 can be either a liquid applied during assembly or a loose sleeve of material slip into each half-pipe section. Silicon rubber is preferable since it holds up to the steam and provides a slick surface for the condensate to run down back to the base manifold 6 where it is collected.

The two half-pipe sections 14 are held together by a slip fitting connector 22. The connector 22 is made from a pipe and secured by standard means to the base manifold 6. An end cap 24 is used to secure the other end of the two half-pipe sections 14, as best shown in FIG. 2. The two half-pipe sections 14 are advantageously fit together with the connector 22 and the end cap 24 without tools, so that the half-pipes can be easily disassembled and be cut to size if needed in the field on a factory floor to permit customization of the size to fit the airduct.

Figure 5:
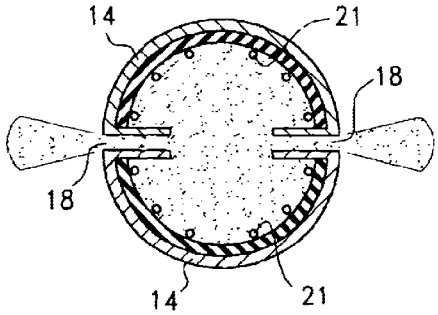
FIG. 5 is a cross-sectional view taken along line 5—5 of FIG. 7.
Figure 6:
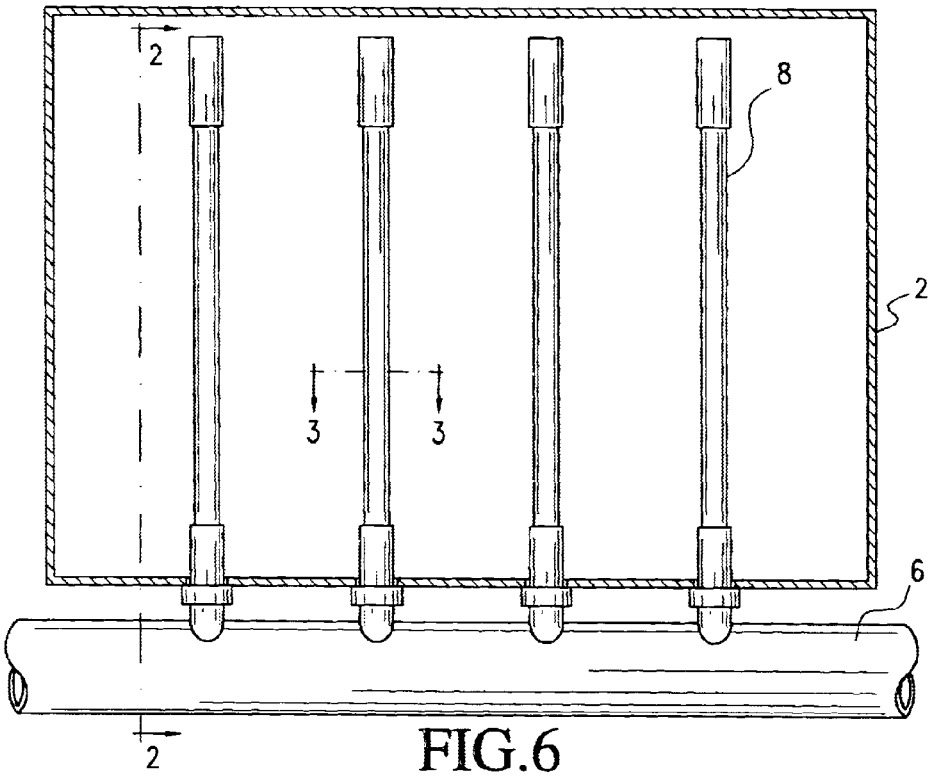
FIG. 6 is a view across the cross-section of the airduct, showing the steam humidifier in a low load or off conditions state.
Figure 7:
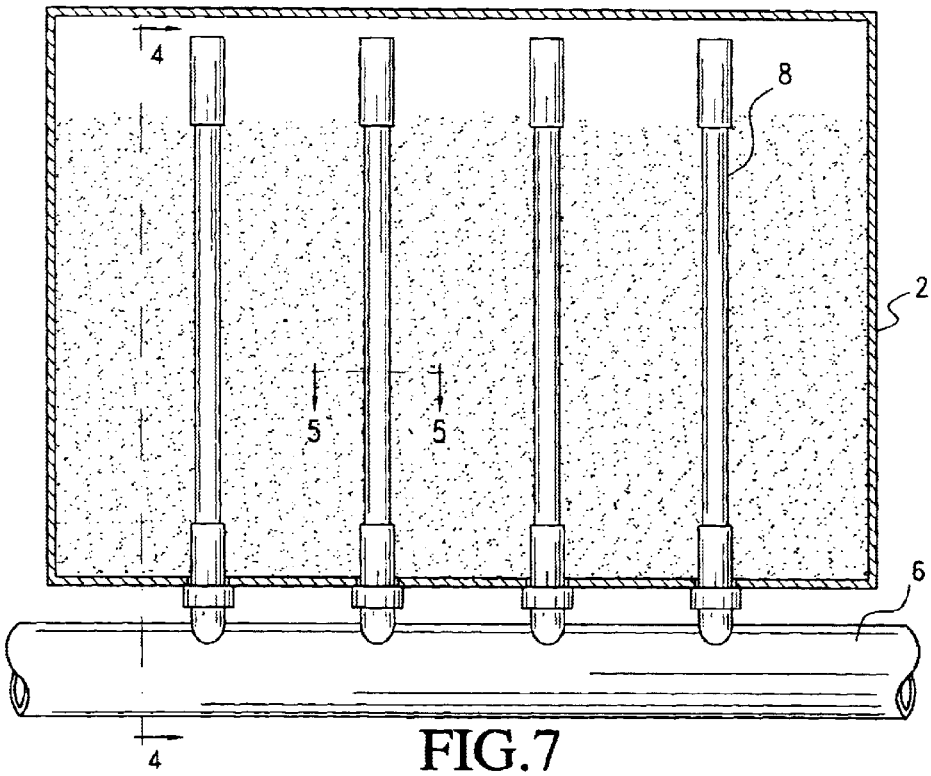
FIG. 7 is a view across the cross-section of the airduct, showing the humidifier generating a sheet pattern of steam substantially perpendicular to the airflow.

Steam is discharged through the slot 18, creating a sheet of steam substantially 90° to the airstream, as best shown in FIGS. 5 and 7. The airstream then turns the sheet and carries it downstream and is absorbed. The contact ratio of steam to air is about 100%, advantageously providing maximum absorption by the airstream.

Figure 4:
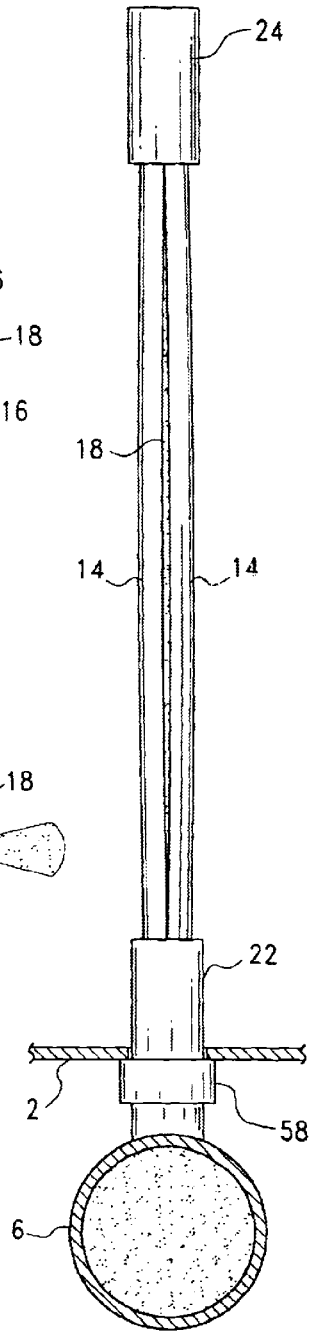
FIG. 4 is a side elevational view, with portions shown in cross-section of the steam humidifier under load conditions.

Each distributor pipe 8 is preferably made from a light gauge stainless steel configured to flex as steam pressure is applied inside the pipe, causing the slots to open or close with the steam flow, thereby providing a variable aperture that will ensure equal distribution over the entire length of the base manifold 6 and therefore the best steam distribution to the airstream within the airduct 2, as best shown in FIGS. 4, 5 and 7.

Under low flow conditions, the slots 18 are mostly closed, ensuring equal steam output over the entire length of the distributor pipe 8. Under high flow condition, the distributor pipe 8 will flex open from the middle, advantageously putting most of the steam in the center of the airstream where it can be most readily absorbed.

Steam enters the distributor pipe 8 from the base manifold 6 and flows upwardly through the openings 7, passing over condensate 21 returning downwardly to the base manifolds 6, as best shown in FIG. 5. The cross-flow operation results in much of the condensate 21 flashing the back into usable steam, as the condensate contacts the rising hot steam.

Figure 8:
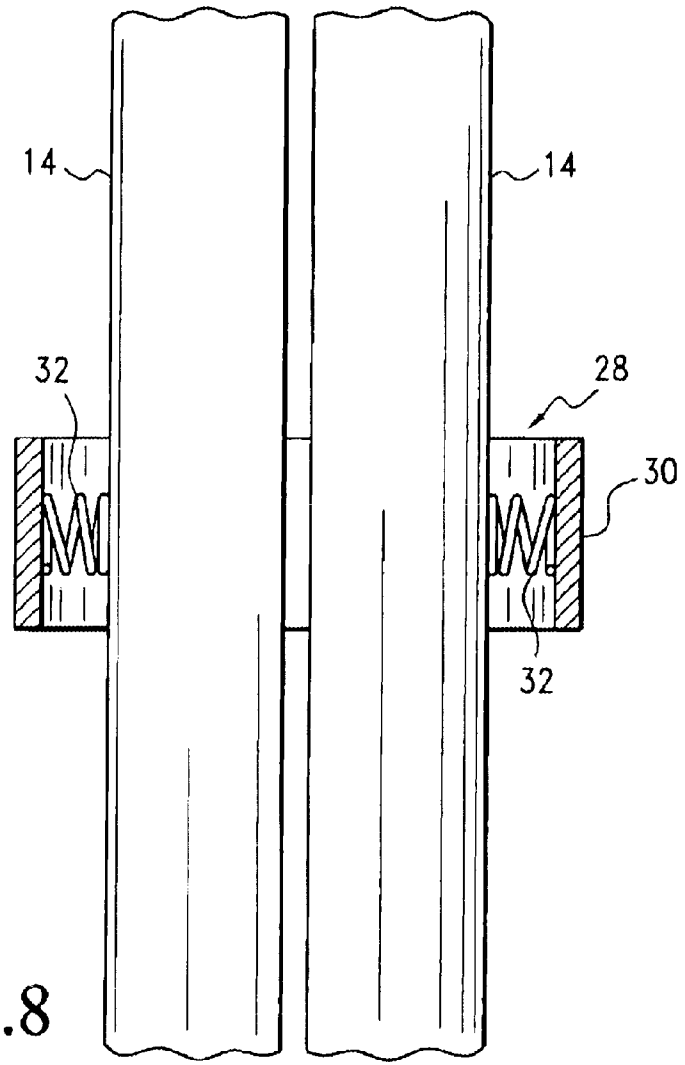
FIG. 8 is an enlarged view of a portion of the distributor pipe showing a clamp assembly using the present invention.
Figure 9:
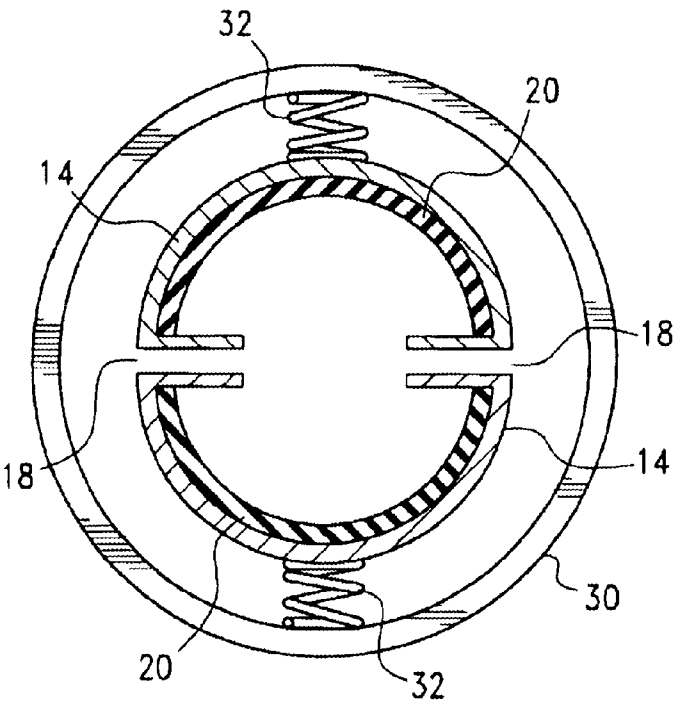
FIG. 9 is a cross-sectional view taken along line 8—8 of FIG. 8.

A spring loaded clamp assembly 28 can be used to advantageously control the flexing of the half-pipe sections 14 during high flow conditions, as best shown in FIGS. 8 and 9. The clamp assembly 28 includes a band 30 with a pair of diametrically opposed springs 32 that are so disposed as to urge the two half-pipe sections 14 towards each other, thereby to control the opening of the slots 18. The springs 32 and the diameter of the band 30 can be sized to provide more or less flex to the half-pipe sections 14.

The clamp assembly 28 is preferably disposed at the middle of the distributor pipe 8 where maximum flex occurs and, therefore, where maximum control is required.

Figure 10:
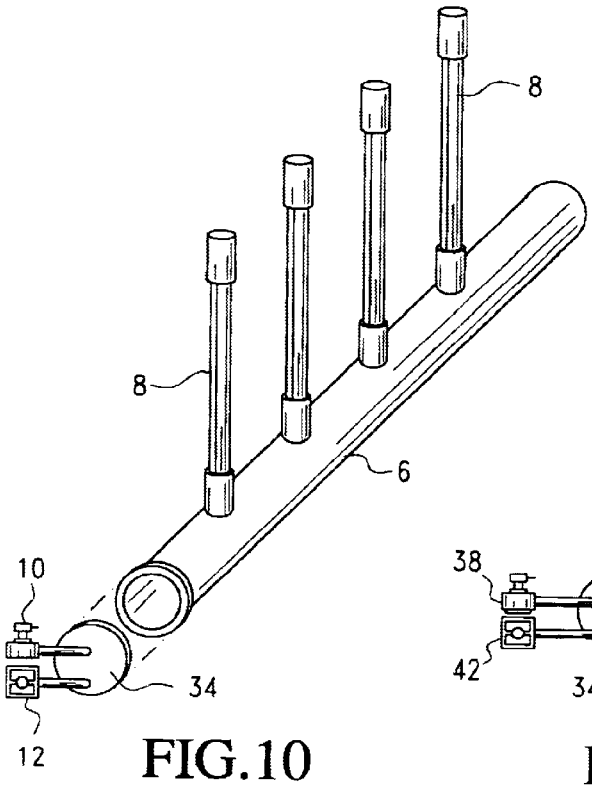
FIG. 10 is a schematic perspective view of the humidifier of the present invention, showing a feed cap removed from the base manifold.

The base manifold 6 can be made from standard stainless steel pipe with a flanged end bell at one end and a feed bell 34 at the other end, as best shown in FIG. 1. The feed bell 34 can easily be removed if retrofitting is required to change the humidifier to a different steam source. A direct steam embodiment is shown in FIGS. 1, 4 and 10, where steam, generated remotely in a boiler, is directly fed into the base manifold 6 and to the several distributor pipes 8.

Figure 11A:
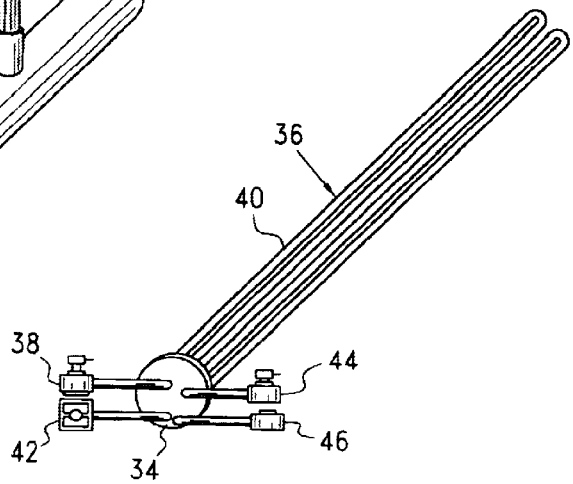
FIG. 11A is a schematic perspective view of a steam heat-exchanger for placement within the base manifold for generation of steam.

A steam-to-steam heat exchanger 36 is disclosed in FIG. 11A. A steam valve 38 is operably connected to a steam source and feeds it to a heat exchanger coil 40, which is adapted to be disposed within the base manifold 6. The other end of the heat exchanger coil 40 is connected to steam trap 42 that permits condensate to drain out but keeps the steam in. A water inlet valve 44 fills the base manifold 6 to an operating level and is controlled by a float or other standard means. A water drain valve 46 permits periodic draining of the base manifold 6 to advantageously reduce mineral build-up. Heat from the coil 40 boils the water to create steam.

Figure 11B:
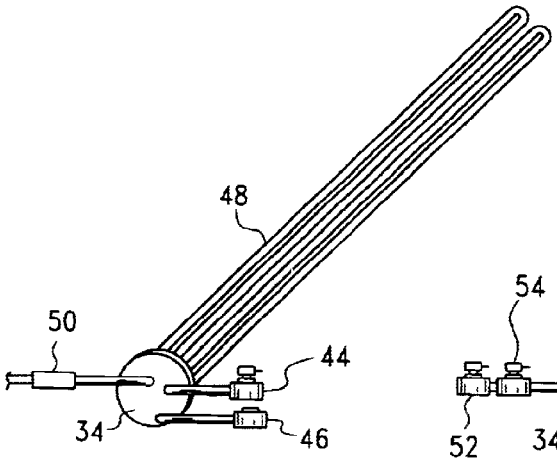
FIG. 11B is a schematic perspective view of an electric coil for placement within the base manifold for generation of steam.

In another embodiment, steam generation is provided by a set of electric coils 48 configured to fit within the base manifold 6, as best shown in FIG. 11B. A switch 50, controlled by standard means such as a humidity sensor, turns the electric col 48 on and off to generate steam as needed.

Figure 11C:
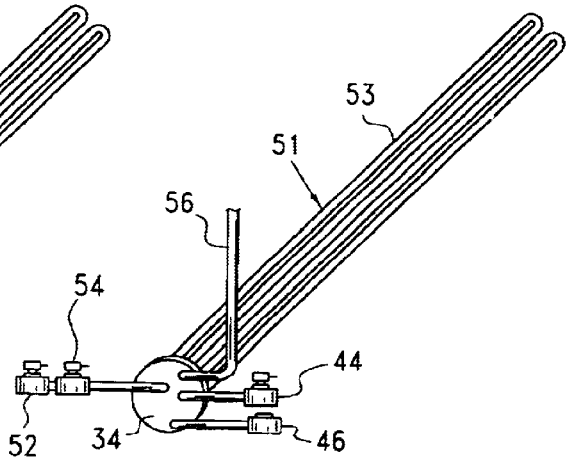
FIG. 11C is a schematic perspective view of a gas-fired heat-exchanger for placement within the base manifold for generation of steam.

Steam generation may also be provided by a gas-fired heat exchanger 51, as best shown in FIG. 11C. Hot flue gas from gas combustion is forced into a heat exchanger coil 53 to boil the water inside the base manifold 6. A gas valve 52, controlled by standard means, is operably connected to a burner 54 which fires into the coil 53, which functions as a flue pipe. An exhaust pipe 56 is operably connected to the coil 53 to vent the products of combustion.

The various means for providing steam for humidification makes the humidifier R advantageously flexible so that the user can easily retrofit the humidifier to a different source of steam to meet his changing needs. For example, the user may start with a direct steam embodiment, where steam is generated remotely from the apparatus. If the boiler treatment chemicals later become a problem, the user can change to a steam or electric heat exchanger or to a gas fired heat exchanger by simply removing the feed bell 34 and inserting within the base manifold 6 one of the heat exchangers disclosed herein.

Mounting collars 58 are used to secure the system R to the airduct 2, as best shown in FIG. 2. Each mounting collar 58 may be made from a steel plate which is then secured by conventional means to the connector 22. Standard fasteners are used to secure the collars 58 to the underside of the airduct 2.

Figure 12:
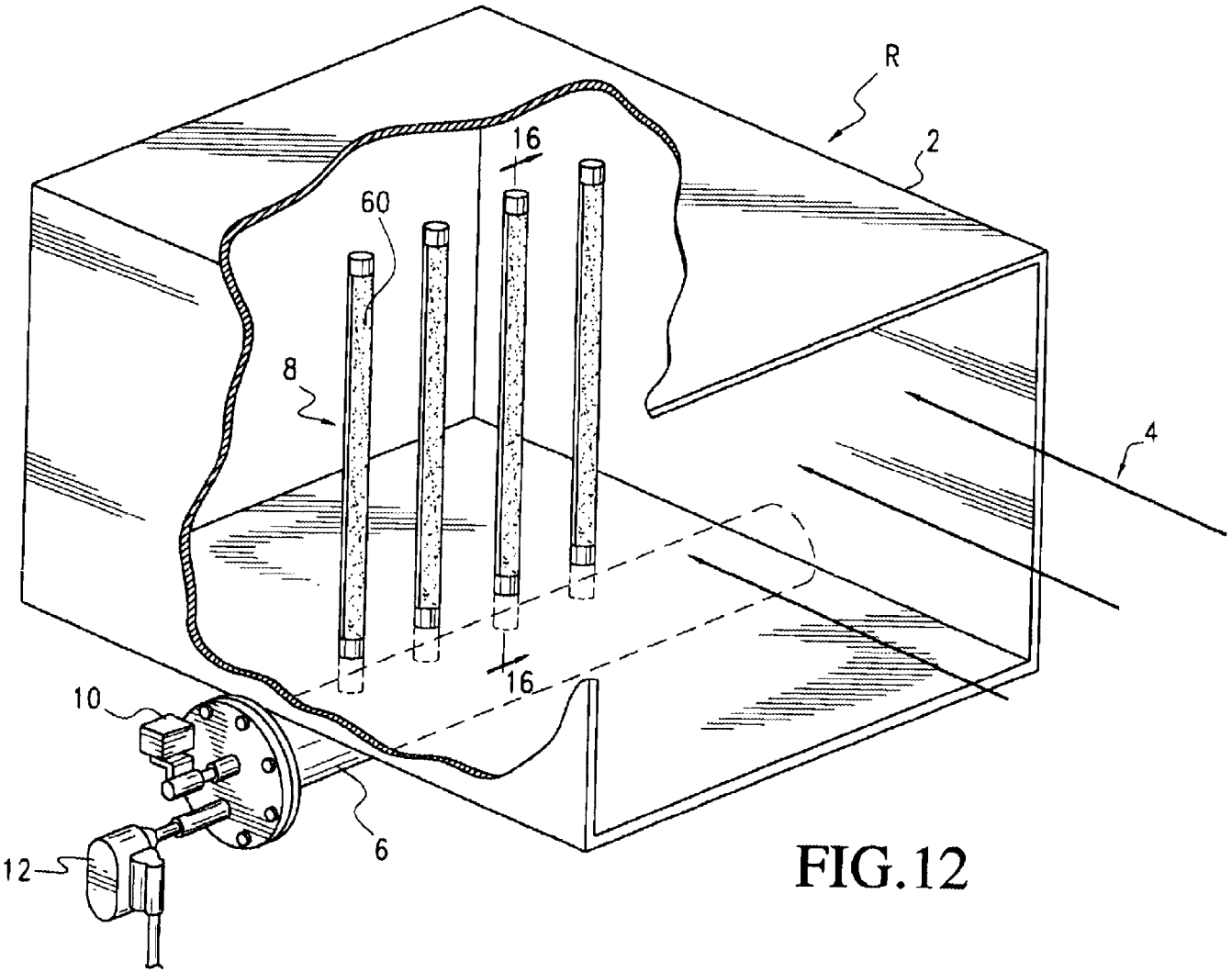
FIG. 12 is a schematic perspective view of another embodiment of a steam humidifier installed in an airduct with portions shown in cross-section and broken out.

In another embodiment of the present invention, each distributor pipe 8 is provided with an insulating layer 60 disposed on the outside arcuate surface of each half-pipe section 14, as best shown in FIGS. 12, 13 and 14. The insulation coating 60 is a ceramic coating sold under the trademark CERAMIC-COVER, made by Therma-Coat, Inc., Chamblee, Ga. 30341. The insulation coating 60 is preferably applied directly unto the exterior surfaces of each distributor pipe 8 by spraying. The insulation coating 60 advantageously maintains the outside temperature of the distributor pipes 8 to about less than 120° F., thereby minimizing heat transfer to the airstream during airconditioning season and to minimize condensate production. By disposing the insulation coating 60 on the outside surfaces of the distributor pipes 8, the inside surfaces remain smooth to facilitate the condensate to flow down back to the base manifold 6 where it is collected and re-evaporated.

Figure 16:
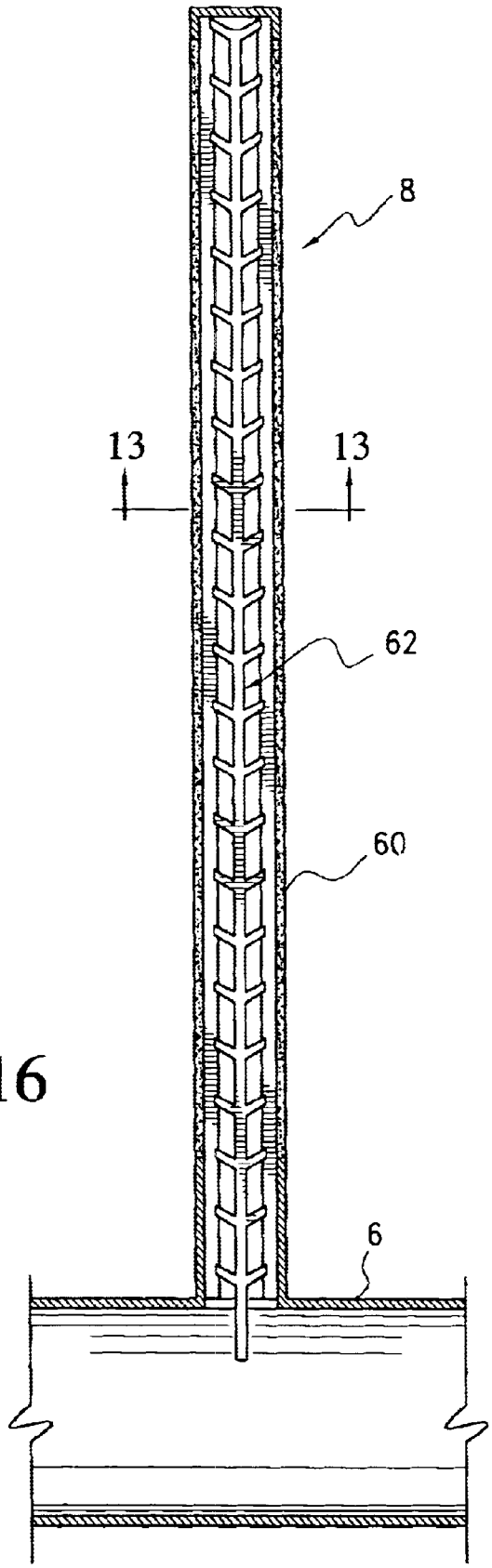
FIG. 16 is a cross-sectional view taken along line 16—16 of FIG. 12.

A condensate structure 62 is disposed within the slots 18 formed by the opposing flange portions 16, as best shown in FIGS. 13, 15, and 16. The structure 62 functions as a wick to collect any condensate forming in the area of the slots 18 and to facilitate flow back toward the center and bottom of the distributor pipes 8 for re-evaporation by the relatively hotter steam coming up from the manifold 6. The condensate is generally indicated at 63 in FIG. 17. The structure 62 is shaped like a tree with a central member 64 disposed within the central interior of the pipes 8 and a plurality of side members 66 directed downwardly toward the central member 64 and the bottom of the pipes 8. The side members 66 are advantageously oriented downwardly toward the central member 64 to aid in directing the flow of the condensate 63 toward the central member 64. The ends of the side members 66 overlap the flange portions 16. The structure 62 is preferably made of stainless steel or any other suitable material. The structure 62 is preferably sized to extend the length of the distributor pipes 8, as best shown in FIG. 16. The structure 62 is secured by conventional means, such as by tack welding to the flange portions 16. The structure 62, which provides the means for guiding condensate toward the interior and bottom of the pipes 8 where the condensate is re-evaporated when it comes in contact with the relatively hotter and drier steam, advantageously increases the efficiency of the humidifier and eliminates spitting, which is condensate being ejected through the slots 18.

The thickness of the structure 62 provides the slots 18 with an initial opening width through which the steam can exit, as generally indicated by the arrows 68 in FIGS. 13 and 17. As the demand increases for humidity and steam pressure is increased into the manifold 6, the distributor pipes 8 will flex open from the middle, due to thermal expansion and increased pressure of the steam, increasing the gap of slots 18 to greater than the initial width, as best shown in FIG. 14.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A humidifier for providing moisture to an airstream, comprising:

a) a pipe having a first end for connecting to a source of steam and a closed second end;

b) first and second slots disposed opposite each other and longitudinally along a portion of the length of said pipe; and c) a plurality of members sandwiched within said first and second slots, said members being disposed toward the interior of said pipe to guide condensate into the interior of said pipe.

2. A humidifier as in claim 1, wherein said plurality of members are disposed downwardly toward the interior of said pipe.

3. A humidifier as in claim 1, and further comprising:

a) a central member disposed within the interior of said distributor pipe; and b) said plurality of members are connected to said central member.

4. A humidifier as in claim 1, wherein:

a) said pipe is made from first and second longitudinal halves;

b) said first and second longitudinal halves each includes longitudinal flanges disposed opposite respective flanges; and c) said plurality of members are sandwiched between said flanges.

5. A humidifier as in claim 4, wherein said flanges include longitudinal edges disposed near a center of said pipe.

6. A humidifier as in claim 1, wherein said first and second slots extend along a major portion of the length of said pipe.

7. A humidifier as in claim 1, wherein said first and second slots extend toward the center of said pipe.

8. A humidifier as in claim 1, wherein said pipe being subject to flexing such that said slots open up to greater than an initial opening width in response to the steam being released through said first and second slots.

9. A humidifier as in claim 1, wherein:

a) said pipe is made from first and second longitudinal halves and joined at said first and second ends; and b) said each first and second longitudinal halves includes longitudinal flanges disposed opposit respective flanges.

10. A humidifier as in claim 1, wherein said pipe is made from first and second longitudinal halves and joined at said first and second ends.

11. A humidifier as in claim 10, wherei:

a) said second end of said pipe includes a slip fitting cap configured to join said first and second halves together; and b) said first end of said pipe is configured to be secured to a base manifold.

12. A humidifier as in claim 1, wherein said pipe includes a layer of insulation disposed on its outside surface.

13. A humidifier as in claim 12, wherein said insulation includes ceramic material.

14. A humidifier as in claim 1, wherein said first and second slots are substantially diametrically opposite each other.

15. A humidifier as in claim 1, wherein said pipe is round in cross-section.

16. A humidifier as in claim 1, wherein said slots are continous along their respective length.

17. A humidifier as in claim 1, wherein said first and second slots include respective opposed sidewalls extending toward the center of said pipe.

18. A humidifier for providing moisture to an airstream, comprising:

a) a pipe having a first end for connecting to a source of steam and a closed second end;

b) first and second slots disposed opposite each other and longitudinally along a portion of the length of said pipe to release steam into the airstream; and c) means for guiding condensate into the interior of said pipe.

19. A humidifier as in claim 18, wherein said slots are continuous along their respective length.

* * * * *